US007987947B2

(12) United States Patent
Christy et al.

(10) Patent No.: US 7,987,947 B2
(45) Date of Patent: Aug. 2, 2011

(54) CALL INDICATOR PROVIDED NEAR ELEVATOR CAR CURRENTLY ASSIGNED TO THE CALL

(75) Inventors: Theresa Christy, West Hartford, CT (US); Jannah Stanley, Cromwell, CT (US); Hideyuki Honma, Shukugawara (JP); Arthur Hsu, South Glastonbury, CT (US); John M. Milton-Benoit, West Suffield, CT (US); Toshimitsu Mori, Kanagawa (JP); Cheong SikShin, Seoul (KR); Hansoo Shim, Seoul (KR); Harold Terry, Avon, CT (US); Mark A. Ross, Shelton, CT (US)

(73) Assignee: Otis Elevator Company, Farmington, CT (US)

( * ) Notice: Subject to any disclaimer, the term of this patent is extended or adjusted under 35 U.S.C. 154(b) by 614 days.

(21) Appl. No.: 12/096,380

(22) PCT Filed: Dec. 15, 2005

(86) PCT No.: PCT/US2005/045519

§ 371 (c)(1),
(2), (4) Date: Jun. 6, 2008

(87) PCT Pub. No.: WO2007/070054

PCT Pub. Date: Jun. 21, 2007

(65) Prior Publication Data

US 2008/0289910 A1 Nov. 27, 2008

(51) Int. Cl.
*B66B 9/00* (2006.01)

(52) U.S. Cl. ..... 187/249; 187/391; 187/382

(58) Field of Classification Search ..... 187/247, 187/249, 380–388, 391–396
See application file for complete search history.

(56) References Cited

U.S. PATENT DOCUMENTS

| | | | | |
|---|---|---|---|---|
| 6,394,231 | B1 | 5/2002 | Schuster et al. | |
| 7,021,429 | B2 * | 4/2006 | Hikita | 187/398 |
| 7,032,716 | B2 * | 4/2006 | Meyle et al. | 187/382 |
| 7,036,635 | B2 | 5/2006 | Rintala et al. | |
| 7,040,458 | B2 * | 5/2006 | Forsythe et al. | 187/396 |
| 7,392,884 | B2 * | 7/2008 | Hikita | 187/249 |
| 7,404,469 | B2 * | 7/2008 | Takeuchi | 187/391 |
| 7,610,995 | B2 * | 11/2009 | Ylinen et al. | 187/382 |
| 7,650,966 | B2 * | 1/2010 | Sansevero et al. | 187/249 |
| 7,793,761 | B2 * | 9/2010 | Oberer | 187/391 |
| 7,854,300 | B2 * | 12/2010 | Nakashima | 187/396 |
| 2001/0035314 | A1 | 11/2001 | Yoshida et al. | |
| 2003/0164267 | A1 | 9/2003 | Hikita | |

* cited by examiner

*Primary Examiner* — Anthony Salata
(74) *Attorney, Agent, or Firm* — Carlson, Gaskey & Olds PC

(57) ABSTRACT

Destination calls entered by means of buttons (21-29) are each given a designation unique to the car and pick-up floor for that call and other calls to be serviced therewith, such as a letter (A-E), which is different from any other outstanding calls. Calls can be reassigned among elevators (UL, LL, UR, LR) whether they are in the same or different hoistways (LF, RT). Signs (31-39, 41-49) adjacent each hoistway are illuminated to display the designation of any call which is being answered by an elevator car approaching the floor. Thus, passengers are informed when their call is being answered by the signs identifying the call, rather than identifying any particular car. Another embodiment identifies (60, 31*a*, 41*a*) the hoistway landing doorway (1, 2) as well as a letter to allow passengers to wait adjacent to the hoistway landing doorway of the car which will serve them.

6 Claims, 8 Drawing Sheets

CALL INDICATOR PROVIDED NEAR ELEVATOR CAR CURRENTLY ASSIGNED TO THE CALL

TECHNICAL FIELD

This invention relates to uniquely identifying every destination call recorded in an elevator system with a designation, such as a letter, different from any other of said calls which are outstanding except calls to be answered therewith; calls may be reassigned to different cars as many times as seems advisable, the car assigned to such call causing an indicator adjacent to the hoistway of such car to display the unique designation of the one or more calls it is responding to as it approaches the floor where the call or calls were entered.

BACKGROUND ART

A recent preference in the manner in which elevator calls are handled includes entry of calls identifying the passenger's desired destination so that the call assignment function can do an improved job of assigning the calls to cars. A competing preference is the passenger's desire to be informed of which elevator, among different hoistways, as well as among different cars in various multi-car hoistways, will respond to his call. In fact, it is necessary to immediately identify to the passengers the designation of the car that will service their call, so that other passengers on the same floor may have their requests distinguished from the first passenger's request. When a car stops at a landing, passengers have to know whether that is the car that they should enter, or not.

Thus, the need to reassign cars for better service is only overshadowed by the need to tell passengers which car to get on, thereby assuring that whatever indication is given to the passenger is the indication of the car arriving at the floor that the passenger should enter.

DISCLOSURE OF INVENTION

Objects of the invention include an elevator system in which: passengers are instantly informed of how to identify a car as it answers their call; elevator calls may be reassigned to different cars, when appropriate; instant indication of how cars responding to calls will be identified is compatible with reassignment of a call, when appropriate, before the call is answered; there is more than one car in a hoistway and elevator calls for service may be reassigned among those cars or cars of an adjoining hoistway; hoistways have either one car or more than one car traveling therein, calls can be reassigned among the cars, and passengers are instantly informed of the designation which will identify the car which will answer their call as it approaches their floor.

According to the present invention, each unanswered call for service in an elevator system is instantly identified with an indicium, such as a letter, a color or other symbol, which will identify to the passenger the car which reaches the landing to provide the service to the passenger's desired destination. Rather than identifying an elevator car per se, as an elevator car approaches a landing to pick up a passenger which that car is to serve, the designation adjacent to the hoistway of that car indicates the symbol of the call that the car is answering. Stated alternatively, a car will cause display of different designations, depending upon which call is being answered by it, and those designations may be shifted between cars along with an assigned call in the event that reassignment of the call, for better service, results in a different car answering the call.

At any one time, each indicium is unique to either a single call or a plurality of calls that will be picked up at the same time and serviced by the same elevator, such as, for instance, during rush hour up-peak traffic.

The invention permits immediate identification to the passenger of how the car responding to the passenger's call will be identified, while at the same time allowing unfettered reassignment of the calls, if and as deemed appropriate. The invention also provides for a given car to first stop at a floor to pick up one or more passengers with a first call indicium, while another one or more other passengers at the same floor with a second call indicium do not enter the car, and thereafter stop at the same floor using the second call indicium to pick up the others. Reassignment of calls may be from a car in one hoistway to a car in another hoistway, or from a car in one hoistway to another car in the same hoistway.

In one embodiment, hoistway landing doors may also be displayed to allow passengers to wait at the door where they will board a car.

The invention provides extreme flexibility in the determination of which car will answer a call, while at the same time providing immediate identification of a car which will answer the call, not by the name of the car but rather by the name of the call.

Other objects, features and advantages of the present invention will become more apparent in the light of the following detailed description of exemplary embodiments thereof, as illustrated in the accompanying drawing.

MODES(S) FOR CARRYING OUT THE INVENTION

Figure 1:
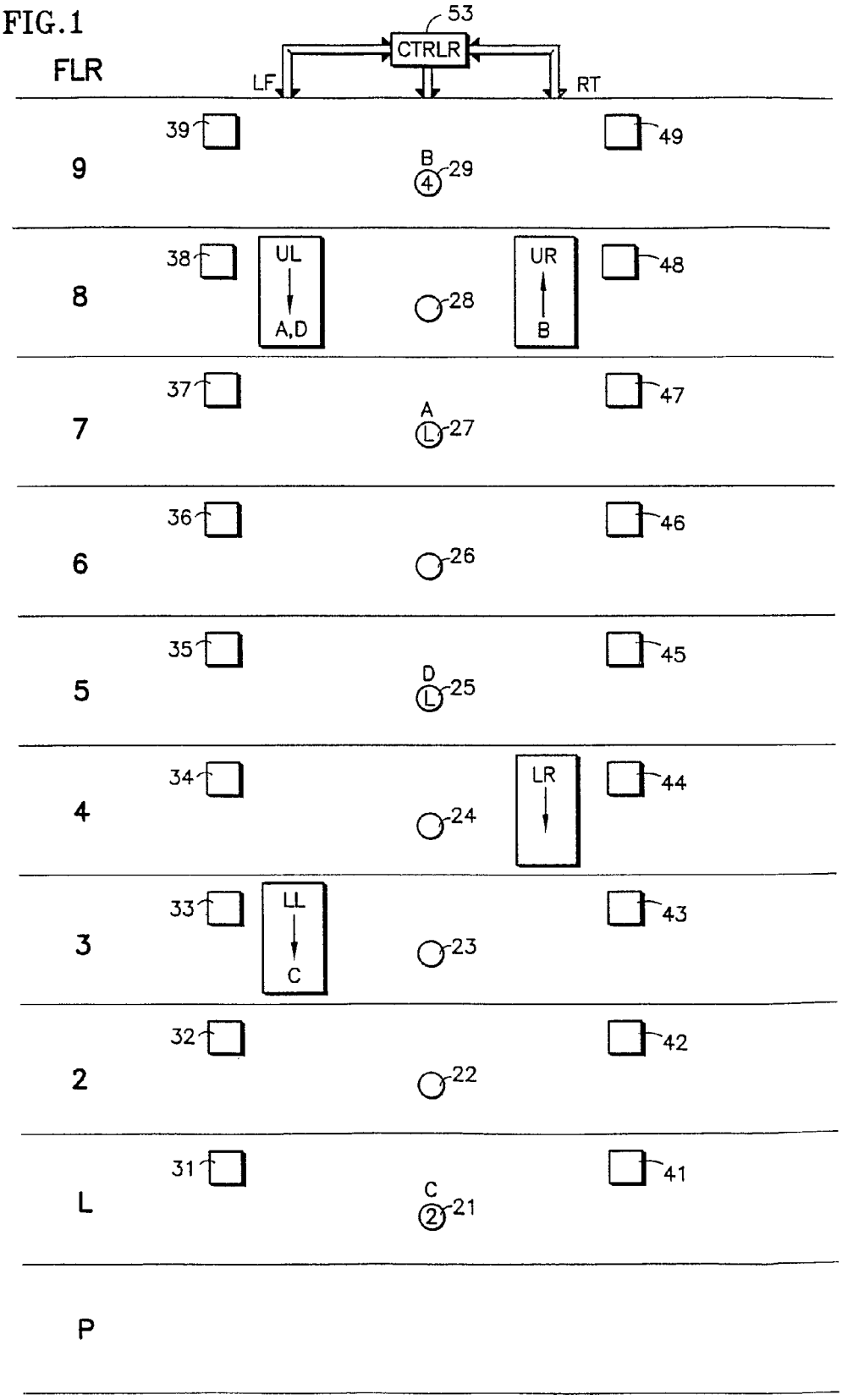
FIGS. 1-4 are simplified, front elevation illustrations of an elevator system having nine floors, two hoistways, and two cars per hoistway, which employs the call identification with reassignment of the present invention.

Referring to FIG. 1, four elevators designated by the hoistway and position therein, upper left (UL), lower left (LL), upper right (UR), and lower right (LR) are deployed in a left hoistway (LF) and a right hoistway (RT). Shown are ten floors including the pit (P) and the lobby (L), as well as floors 2-9.

On each floor (except the pit) there is a call button 21-29, within which is designated the destination floor of a call which has been entered by pressing the button. Although only one call button 21-29 is shown on each floor, the invention is described with respect to a system having destination call entry, such as a ten key system or an N-key system, such that a call is entered by indicating the desired destination of the passenger. Thus, the buttons 21-29 in the configuration of FIGS. 1-4 should be understood as representing call entry panels, similar to call entry panel 21*a* in FIG. 8, with keys and a display for call identification indicia. The call button 21 requests service to the second floor, the call button 25 requests service to the lobby, the call button 27 requests service to the lobby, and the call button 29 requests service to the fourth floor. Above each of the call buttons 21, 25, 27, 29 there is a letter indicating the identification of that call, in accordance with the invention.

Each service floor of the left hoistway has a plurality of car identifying signs 31-39, and each service floor of the right hoistway has a plurality of similar car identifying signs 41-49. At the bottom of some of the elevator cars where appropriate, there are letters indicating calls currently assigned to that car, such as by a controller 53. Thus, at the time indicated in FIG. 1 the upper left car has been assigned both call A (from the seventh floor to the lobby) and call D (from the fifth floor to the lobby). The lower left car has been assigned call C (from the lobby to the second floor); the upper right car has been assigned call B (from the ninth floor to the fourth floor); and the lower right car has no calls assigned to it at this time. The arrows within each car indicate the direction that the car is traveling.

Figure 2:
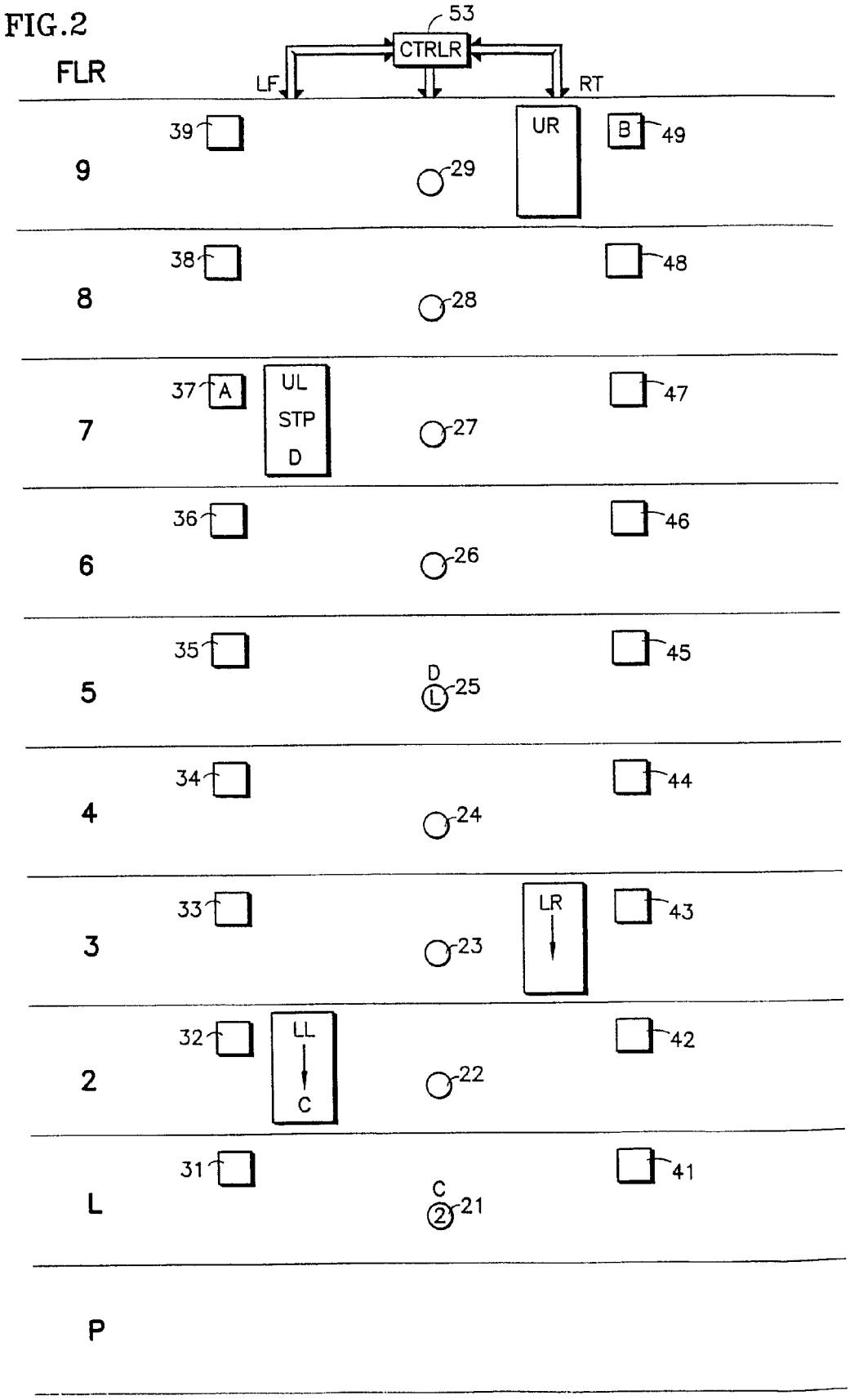

FIG. 2 illustrates a time later than FIG. 1; however, not all of the events depicted in FIG. 2 occur simultaneously, and the illustrations in FIGS. 1-4 are merely exemplary of the invention, and not necessarily indicative of time-coordinated events.

In FIG. 2, the upper left car has reached the seventh floor to answer call A, so the sign 37 displayed an A which was displayed to the passenger on the seventh floor when call A was entered at the call button 27, as the car approached the seventh floor to answer the call. The upper right car has reached the ninth floor to answer call B so the sign 49 displays the letter B, which was displayed to the passenger on the ninth floor at the time that the call button 29 was pressed to enter the call.

In FIG. 2, the lower left car is still assigned to call C which has been entered at the lobby with the second floor as its destination; the lower right car still has no call assigned to it.

Figure 3:
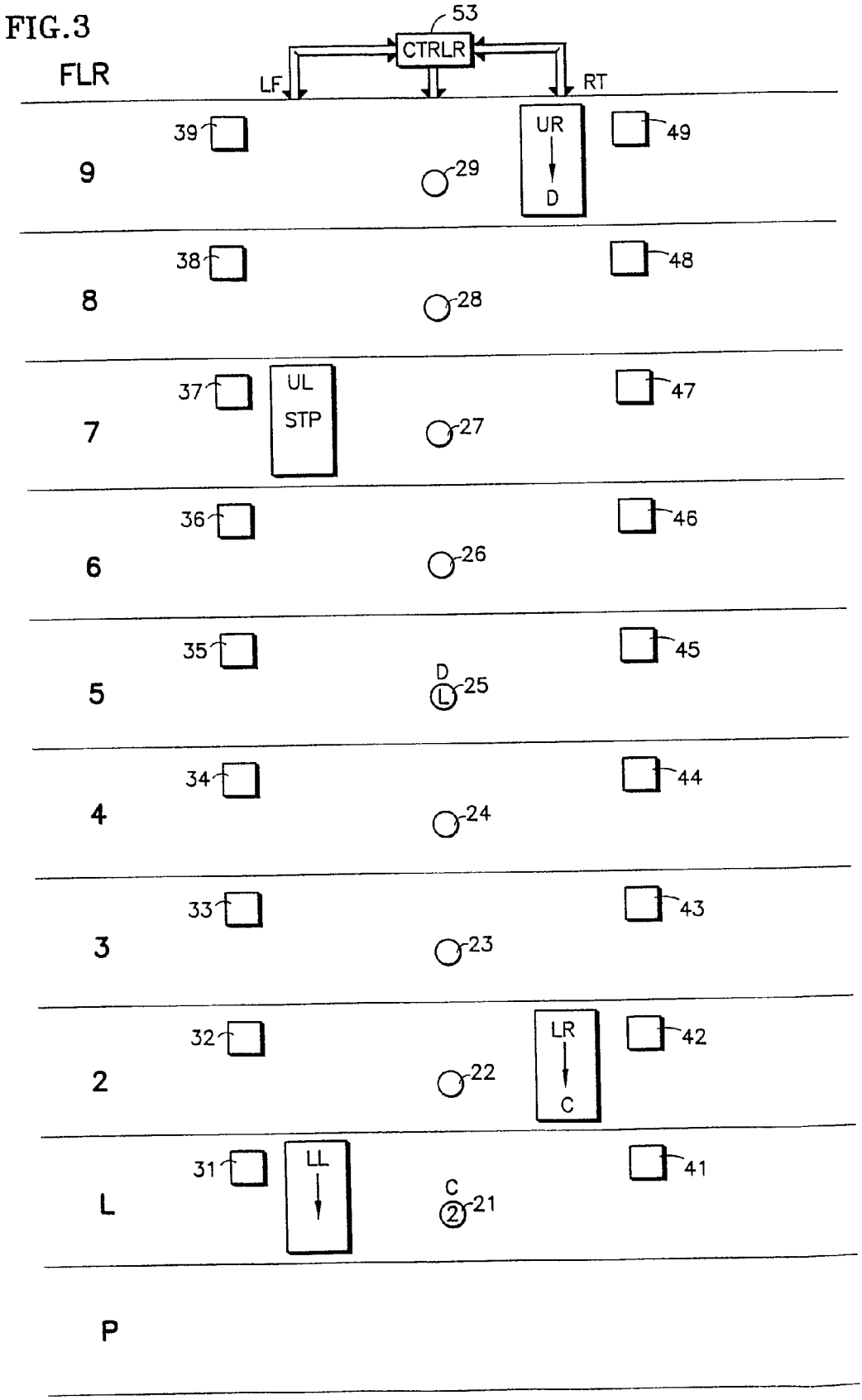

It is assumed in FIG. 2 that the stop button in the upper left car has been pressed, thereby indicating to the call assignment function in the controller 53 that the upper left car will be delayed at the seventh floor. In FIG. 3, the upper left car remains stopped at the seventh floor, and as a consequence, call D, entered at the fifth floor requesting service to the lobby, has been reassigned to the upper right car. Because the upper left car may reach the lobby before the lower left car could respond to call C and then travel to the pit to get out of the way of the upper left car, call C has been reassigned to the lower right car on the assumption that it can respond to call C, travel to the second floor and thence to the pit prior to the time that the upper right car will reach the lobby. It is assumed that should one car be in danger of collision with another car, steps, will be taken to avoid the collision, such as slowing or stopping cars. This is however not relevant to the present invention.

Figure 4:
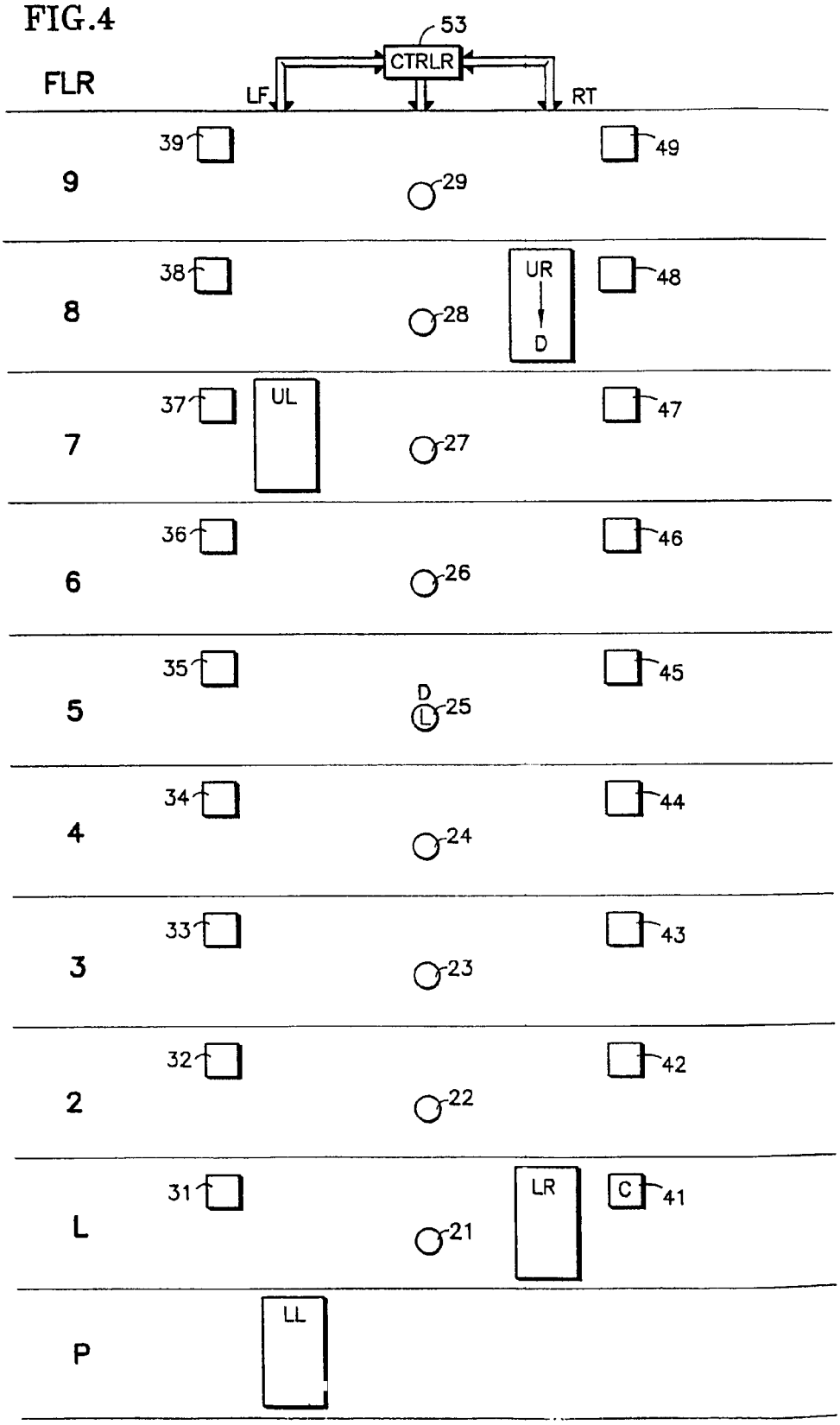

In FIG. 4, the lower right car has reached the lobby and the sign 41 has displayed a C so as to indicate to the passenger on the lobby floor that this car is answering the call which was identified with a C when the passenger entered the call at the button 21.

The lower left car has reached the pit and will remain there until the upper left car leaves the lobby after serving call A, which was entered on the seventh floor with the lobby as its destination. The upper right car is proceeding downwardly to answer call D at the fifth floor, and when it reaches the fifth floor, the sign 45 will have a D displayed therein, which is the same designation as was displayed to the passenger on the fifth floor when he entered his call at the button 25.

In the embodiment of FIGS. 1-4, reassignment of calls to cars in a hoistway different than the hoistway of the first assigned car is illustrated. The invention will also permit reassignment of a call from one car in a hoistway to another car in the same hoistway. In FIGS. 3 and 4, call D, entered on the fifth floor, may very well have been reassigned to the lower left car. Thereafter, call C may have been reassigned to the upper right car, rather than the lower right car.

Figure 5:
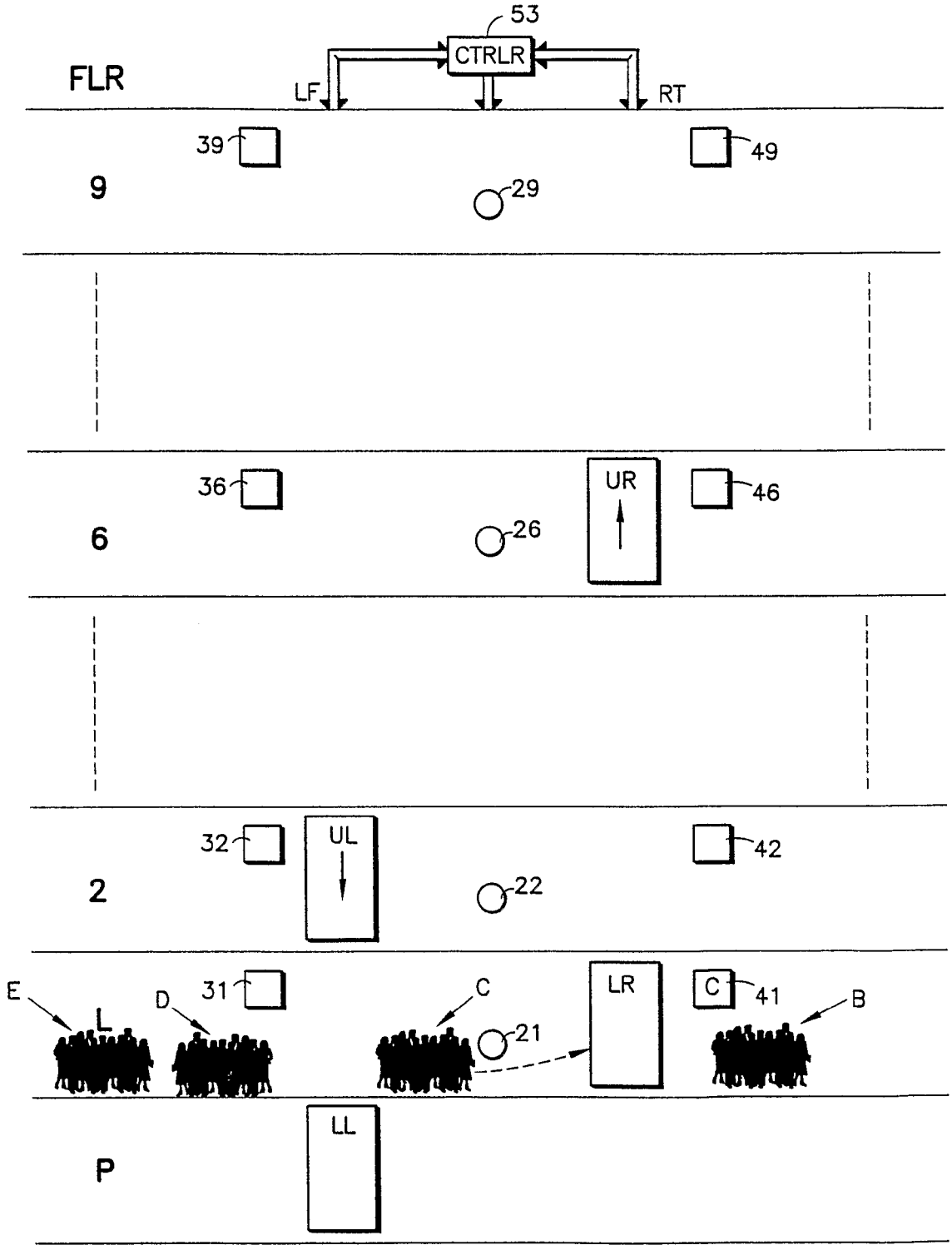
FIGS. 5-7 are partial illustrations as in FIGS. 1-4, illustrating the invention during up-peak traffic.
Figure 6:
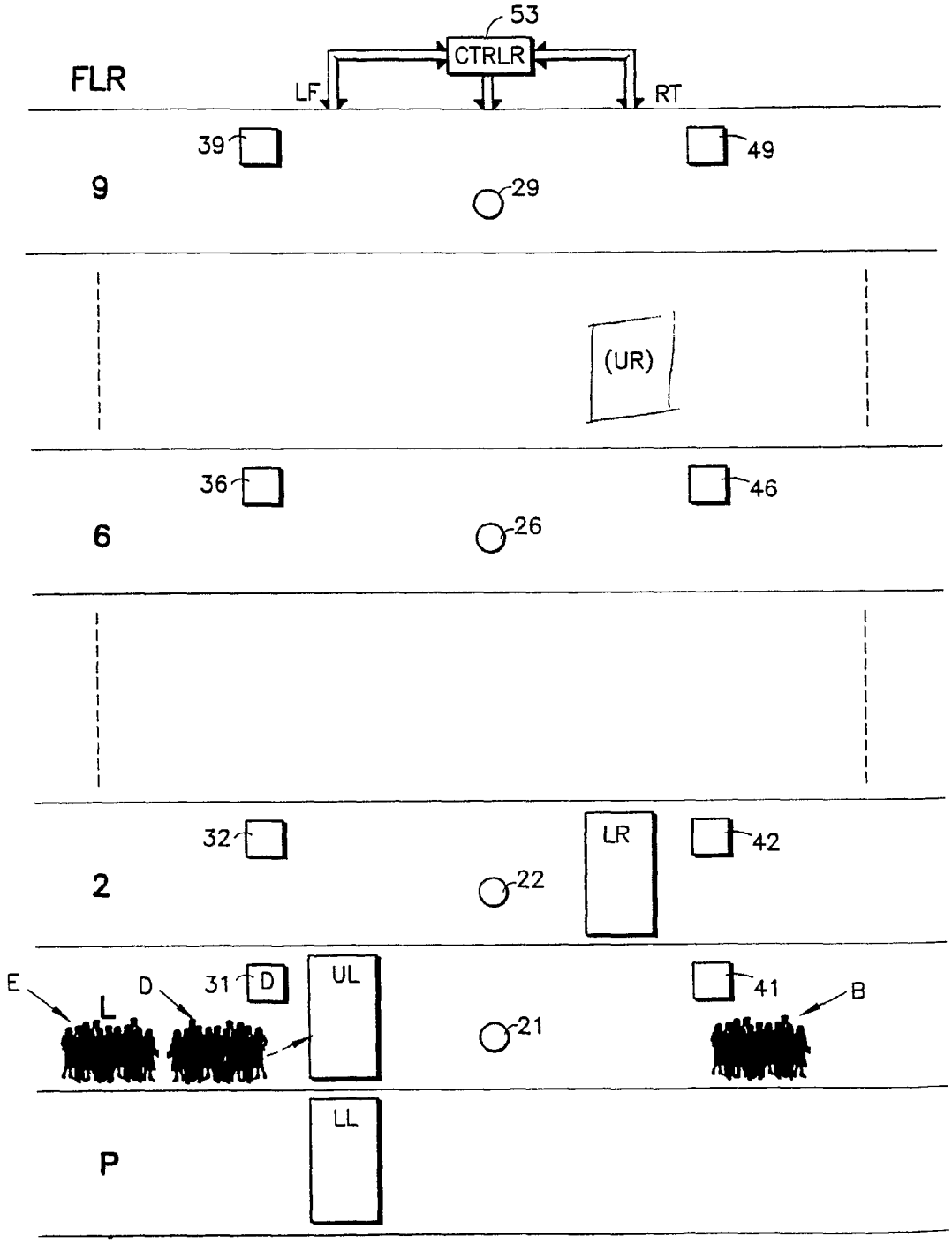
Figure 7:
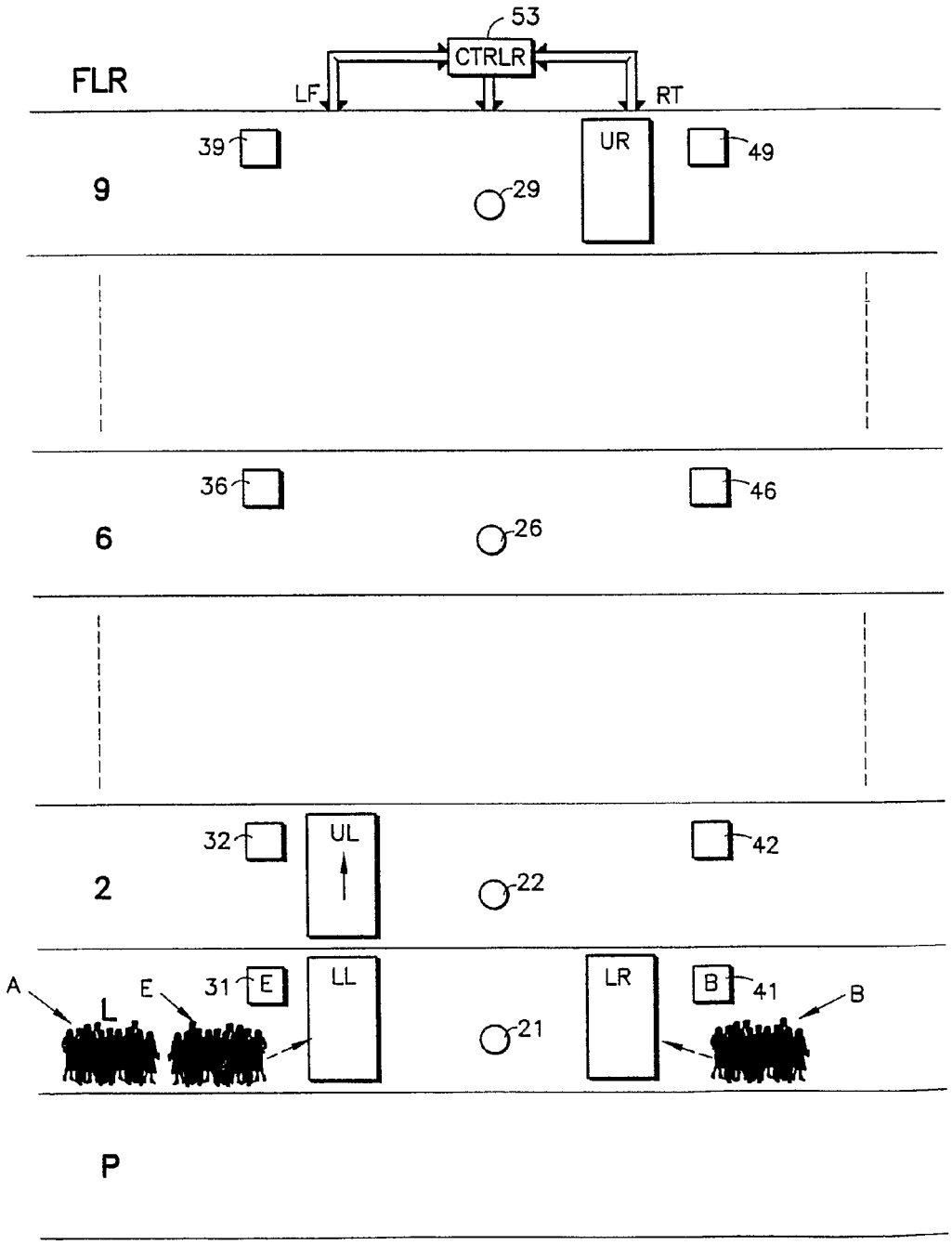

Another illustration of utilization of the present invention is bundling of crowds of people during morning up-peak traffic, as illustrated in FIGS. 5-7. Grouping people by their destinations is the best way to quickly move people to upper floors during up-peak traffic. When destination call entry is utilized, each passenger knows that he or she must enter a call, either just for one person, or for that person plus a companion or two. Thus, the count of crowds behind the calls can be far more accurate than in conventional, non-destination-call systems. The group of passengers need not all be going to the same destination; as in "sectoring" or "channeling", they need only be assigned together for service by the same car. Thus group C may, for instance, include passengers for floors five through seven; group D may include passengers for floors two through 5; and so forth.

In FIG. 5, the lower left car is in the pit, the upper left car is heading down through floor two, the upper right car is heading up through floor six, and the lower right car, which has been assigned to pick up passengers whose calls were designated with a "C", has arrived at the lobby. The signage 41 illustrates that passengers whose calls were identified will board the lower right car at this time, which is indicated by the dotted line from the group C. Three other groups, E, D, B are also awaiting calls.

In FIG. 6, the lower right car has moved to the second floor to discharge passengers and the upper right car is moving upwardly through the seventh and eighth floors. The lower left car is still in the pit, and the upper left car has reached the lobby and the sign 41 has indicated that passengers whose call has been assigned D should enter the upper left car at this time, as indicated by the dotted arrow. The groups B and E are still awaiting cars assigned to them.

In FIG. 7, the upper left car is traveling upwardly through floor two, the lower left car has reached the lobby, and the sign 31 indicates that passengers whose call is assigned E should enter the lower left car at this time, as indicated by the dotted arrow. The upper right car has reached the ninth floor to discharge passengers. The lower right car has returned to the lobby floor and the sign 41 indicates that passengers whose calls were identified with a B should enter the lower right car at this time, as indicated by the dotted arrow. Thus, the lower right car was designated as responding to calls identified as C, in FIG. 5, and the same lower right car is identified as responding to calls identified with a B a short time thereafter, in FIG. 7. At a subsequent point of time, either or both of the lower cars may be in the pit and one of the upper cars will be designated as responding to calls identified with an A. The upper left car was identified as responding to calls identified with a D in FIG. 6. This illustrates how call identification (rather than assigned car identification) permits the same car to arrive with its door open and yet not be responded to by some passengers, such as group B with respect to the lower right car in FIG. 5, while responding to the same lower right car arriving at the same floor with its doors open with a different call identification in the sign, such as the group B in FIG. 7.

In the embodiment of FIGS. 1-4, reassignment of calls to cars in a hoistway different than the hoistway of the first assigned car is illustrated.

The invention has been described with simple examples illustrating that by designating each call with a unique symbol, reassignment of the call among cars (FIGS. 1-4) and successive assignment of the same car to the same floor (FIGS. 5-7) will not adversely affect service, since signs at each landing will indicate to the passengers the call that is being responded to as it approaches the landing to service the call, rather than indicating a car.

Figure 8:
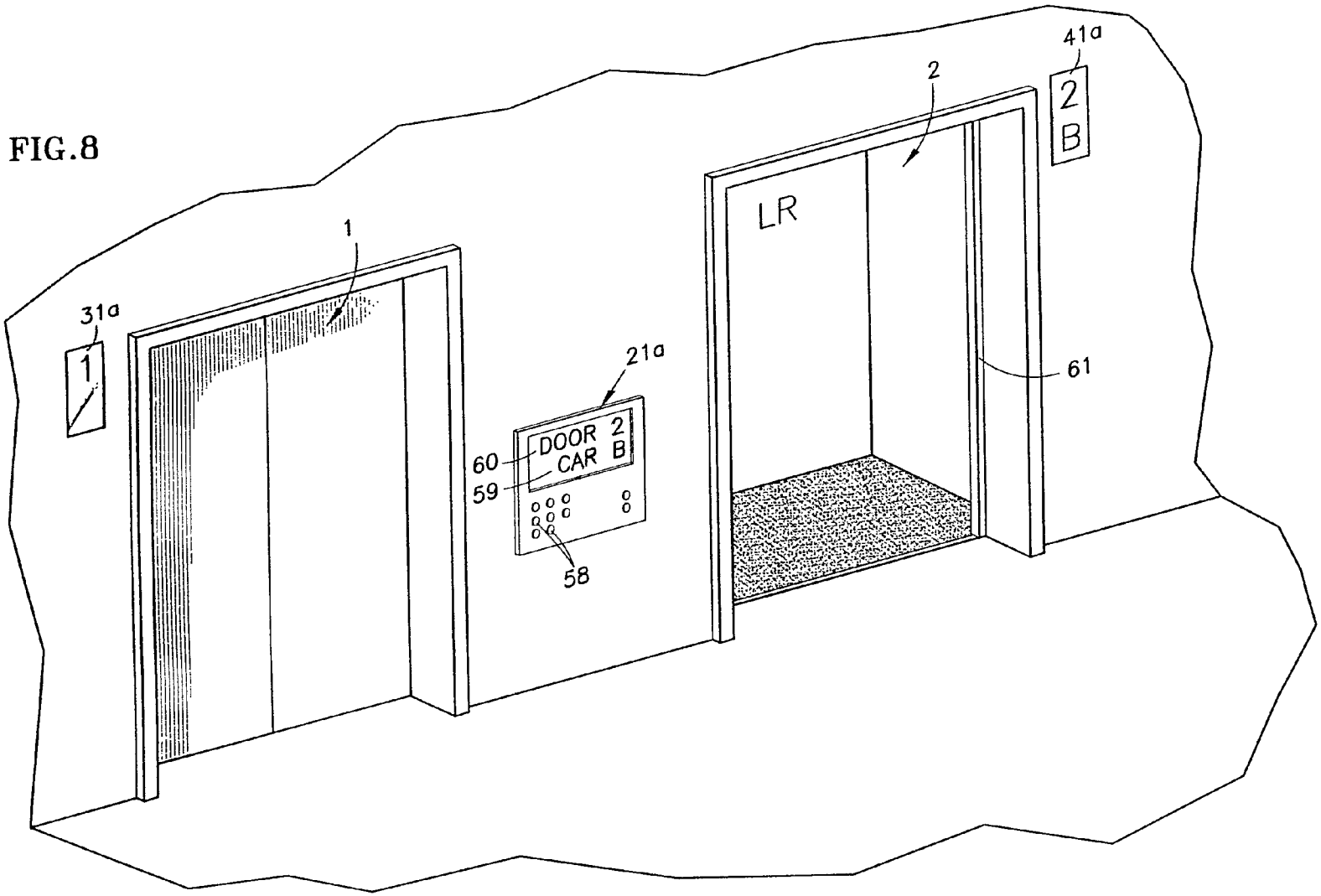
FIG. 8 is a partial front elevation view illustrating hoistway door identification with the invention.

Another embodiment of the invention, illustrated in FIG. 8, allows passengers to congregate near the door where they will be served. Therein, whenever a call is entered by selecting a button 58 on the call entry panel 21*a*, in addition to identifying, on a display 59, the character which will identify the call that a car is responding to, the hoistway landing doorway through which the passenger should enter (the car) is also identified on a display 60. Thus, in FIG. 8, the lower right car has reached the lobby in the right hoistway 2 with the landing doors 61 open to pick up calls identified with a B. In this embodiment, calls can only be reassigned among the two or more cars within the same hoistway, since that is where the passengers have been assured they will be picked up. The advantage of this embodiment of the invention is that it provides a more orderly lobby, with less scrambling among passengers to reach cars that are appropriately identified. The passengers who will enter through doorway 1 will be near doorway 1 and the passengers who will enter through doorway 2 will be near doorway 2, so that they need not push past each other once the appropriate car has arrived as indicated by the signs 31*a*, 41*a*.

Separate car and group controllers may be employed within the purview of the invention, all lumped together in controller 53 herein for simplicity.

The invention claimed is:

1. An elevator system serving a plurality of floors of a building, comprising:

one or more hoistways;

at least two elevator cars traveling in said one or more hoistways;

a call entry panel on each of said floors, each all entry panel having a call entry feature with which prospective passengers can enter a desired destination floor thereby registering a call for service to said desired destination floor;

said call entry panels each having a display for identifying each registered call, by displaying a selected one of a plurality of call identifiers that are distinct from an identifier of the desired destination;

a controller configured to be responsive to the registering of each call for instantly causing the corresponding one of said call entry panels to display the selected call identifier which uniquely identifies either (a) just the corresponding call or (b) a plurality of calls entered on the same floor and to be answered simultaneously by the same one of said elevator cars;

said controller being configured to assign each unanswered registered call to one of said elevator cars as determined by initial conditions in said system in compliance with an assignment strategy at the time of registering said corresponding call, and to successively reassign each registered call to successive ones of said cars under conditions in said system subsequent to said initial conditions when required to comply with said strategy;

a sign adjacent each of said one or more hoistways on each of said floors, each of said signs operable to display any selected call identifier of a call assigned to the elevator in the corresponding hoistway; and said controller being configured to cause the selected call identifier corresponding to one of said calls to be displayed on the one of said signs on the departure floor of said one call adjacent to the hoistway in which the car currently assigned to said one call is running as the elevator car that is currently assigned to said one call approaches said departure floor to receive passengers in response to said one call.

2. A system according to claim 1 wherein:

there is only one car in each of said one or more hoistways.

3. A system according to claim 1 wherein:

there are a plurality of cars in each hoistway.

4. A method of operating an elevator system serving a plurality of floors of a building which has one or more hoistways with at least two elevator cars traveling in said one or more hoistways, and which has a call entry panel on each of said floors, each call entry panel having a call entry feature with which prospective passengers can enter a desired destination floor thereby registering a call for service to said desired destination floor, the method comprising the steps of:

displaying in response to the registering of each call, on a corresponding one of said control panels, a selected one of a plurality of call identifiers that are distinct from an identifier of the desired destination, the selected call identifier uniquely identifies either (a) just the corresponding call or (b) a plurality of calls entered on the same floor and to be answered simultaneously by the same one of said elevator cars;

assigning each unanswered registered call to one of said elevator cars as determined by initial conditions in said system in compliance with an assignment strategy at the time of registering said corresponding call, and successively reassigning each registered call to successive ones of said elevator cars under conditions in said system subsequent to said initial conditions when required to comply with said strategy; and displaying the call identifier corresponding to one of said calls on a sign on the departure floor of said one call adjacent to the hoistway in which the elevator car that is currently assigned to said one call is running as said currently assigned car approaches said departure floor to receive passengers in response to said one call.

5. A method according to claim 2, comprising:

during up-peak traffic, displaying in response to the registering of any calls made within a short time of each other, for destination floors within a range of a small number of contiguous floors, the same selected one of said call identifiers.

6. A method according to claim 4 of operating an elevator system having a plurality of hoistways having landing doorways, comprising:

displaying with said selected call identifier a second indicium indicative of one of said plurality of hoistway landing doorways at which the corresponding call will be answered.

* * * * *